US005613627A

United States Patent [19]

Marks

[11] Patent Number: 5,613,627

[45] Date of Patent: Mar. 25, 1997

[54] ADJUSTABLE GARMENT HANGER

[75] Inventor: Joel S. Marks, Los Angeles, Calif.

[73] Assignee: WorkTools, Inc., Chatsworth, Calif.

[21] Appl. No.: 405,081

[22] Filed: Mar. 16, 1995

[51] Int. Cl.[6] ..... A47G 25/14; A47G 25/20

[52] U.S. Cl. ..... 223/85; 223/92; 223/98

[58] Field of Search ..... 223/85, 88, 89, 223/92, 94, 98; D6/315, 328

[56] References Cited

U.S. PATENT DOCUMENTS

| | | | |
|---|---|---|---|
| 2,582,669 | 1/1952 | Battle | 223/89 |
| 2,589,374 | 3/1952 | Hannon | 223/89 |
| 2,716,512 | 8/1955 | Needles | 223/85 |
| 4,632,287 | 12/1986 | Bevelander | 223/98 |
| 4,717,053 | 1/1988 | Wang | 223/94 |
| 5,085,358 | 2/1992 | Lam | 223/89 |

FOREIGN PATENT DOCUMENTS

| | | | |
|---|---|---|---|
| 203175 | 3/1959 | Australia | 223/89 |
| 61990 | 6/1948 | Netherlands | 223/89 |

OTHER PUBLICATIONS

WO86/06600, WIPO Publication, Oct. 1985, Kodet, 223/94.

*Primary Examiner*—Bibhu Mohanty

*Attorney, Agent, or Firm*—Paul Y. Feng; Fulwider, Patton, Lee & Utecht, LLP

[57] ABSTRACT

An adjustable garment hanger comprising of a frame depending from a hook is disclosed. The frame is comprised of two inclined arms intersected by an optional cross bar. Within each inclined arm is an integrally formed locking bar that extends from the integral base to a free distal end. Each locking bar includes notches and a pushbutton at the distal end. Ribs that form channels and that may form ramps are disposed on the sides of the inclined arms. Movable covers having internal ribs slide onto each inclined arm while the internal ribs engage the ramps, channels, and notches. The ribs when supported by the ramp causes the outer ends of the covers to be tilted upwards. Other ribs located on the covers engage the notches of the locking arms thereby fixing the relative extended or retracted position of the covers to the inclined arms. The locking arms are biased outward away from the frame thereby placing the notches into engagement with the ribs of the cover. The locking arms can be disengaged from the covers by thumb or finger pressure on the pushbuttons. The adjustable hanger frame has a T- or I-shape cross section.

25 Claims, 3 Drawing Sheets

ADJUSTABLE GARMENT HANGER

BACKGROUND OF THE INVENTION

1. Field of the Invention

The present invention relates to a garment hanger. More precisely, the present invention relates to an adjustable garment hanger that has movable shoulder members that tilt, slide inward or outward, and are locked in place by push-button control.

2. Description of Related Art

There have been many attempts at designing a hanger that is suitable for use with a variety of garments. This is a complicated task considering that garments come in a variety of shapes, fabrics, weights, sizes, etc. The wrong type of hanger for a certain garment may very well damage the appearance of the garment, if not shorten the life of the garment due to wrinkles, improper airing, stretching, distortion, or the like.

U.S. Pat. No. 2,620,102 to F. H. Bremer attempted to address some of those issues by providing a garment hanger with shoulder pieces that extend outward to make the hanger wider. The Bremer hanger, as were most hangers of that era, was made of solid wood.

U.S. Pat. No. 2,817,471 to L. R. Stoschy discloses a wooden hanger that has outward extending members at the outer tips of the hanger frame. The Stoschy hanger further has downward sloping shoulder bars that are hinged in the middle to adjust the angle of the shoulder area.

U.S. Pat. No. 2,525,142 to A. Levinson discloses a garment hanger with movable and adjustable shoulder pieces to accommodate coats, jackets and the like of different widths. The Levinson hanger has complicated hardware insofar as the movable shoulder pieces slide within dovetail tracks on the main part of the frame and are locked into place by screws.

The foregoing designs were directed to wooden garment hangers. There have also been developments in the area of wire garment hangers. Compared to wood hangers, wire hangers were very inexpensive to fabricate and so if cost was a concern, many businesses opted for wire hangers instead of wooden hangers.

U.S. Pat. No. 2,360,119 to Gallagher discloses a wire hanger having tubing that covers the outer extremes of the hanger, which tubing can adjust outward to increase the width of the hanger to accommodate different articles of clothing. Similarly, U.S. Pat. No. 3,005,579 to Thurber discloses an adjustable coat hanger primarily made of metal wire with shoulder pieces that slide along the shoulder portion of the wire frame.

U.S. Pat. No. 3,039,662 to Strong discloses an attachment for a garment hanger. The attachment is a shoulder piece that attaches to the wire or rigid hanger by friction fit; the shoulder piece slides up and down the sloped shoulder portion of the hanger. This action adjusts the hanger to various widths.

U.S. Pat. No. 2,491,836 to E. W. Simmet discloses an adjustable clothes hanger having a wire frame that has a substantially triangular shape. In this device, the ends of the frame telescope outward to adapt the hanger to larger size clothing.

U.S. Pat. Nos. 2,596,576 to MacSpadden, 2,709,026 to MacKenzie, and 2,820,583 to Mills all disclose adjustable shoulder pieces that add on to a wire frame. The shoulder pieces provide more support for the garment and can be adjusted to change the width of the wire frame hanger.

Although wire hangers are inexpensive to fabricate, they are typically very flimsy and cannot support the weight of a heavy coat, for example, without collapsing. Furthermore, the friction based adjustment in the foregoing hangers oftentimes move unintentionally. Accordingly, there have been improvements to find a more rigid hanger that nevertheless has adjustable features.

For instance, U.S. Pat. No. 2,900,117 to D. Veltry discloses an adjustable garment hanger wherein movable shoulder members slide along the shoulder portion of the frame and lock into place by use of a spring-loaded, hinged finger that engage notches spaced apart along the shoulder area of the frame.

U.S. Pat. No. 4,905,877 to Gatling discloses an adjustable garment hanger having a pair of oppositely extending arms engaged within a pair of auxiliary sleeves which may be adjusted to provide hanger arms of variable lengths. The sleeves slide in and out along the arms while a detent inside the sleeves engage a plurality of notches thereby setting the relative position of the sleeve.

U.S. Pat. No. 4,981,242 to Grahm discloses a clothes hanger assembly that has a tubular center segment through which a deformable wire extends. The exposed ends of the wire are inserted into tubular foam rubber sleeves which are then compressed by end pieces threaded onto the wire ends. Rotating the end pieces advances or unscrews the end piece on the threaded center wire thereby adjusting the overall width of the hanger. U.S. Pat. No. 3,549,063 to R. W. Campbell shows an adjustable garment hanger having sliding shoulder pieces that lock into place by tightening wing nuts.

U.S. Pat. No. 4,895,283 to L. W. Evangelist et at. discloses an adjustable garment hanger having notches spaced apart along the upper portion of the shoulders of the hanger, wherein shoulder extensions hook into the notches in order to adjust the hanger for various shoulder widths. Operating on a similar principle, U.S. Pat. No. 2,652,958 to R. E. Alvord discloses an adjustable garment hanger comprised of a frame with small openings spaced apart along the top of the shoulder area, and shoulder pieces with downward extending plugs or buttons that slide into the openings to lock the two structures together. The shoulder pieces then can be extended outward or retracted inward by relocating the plug.

U.S. Pat. No. 2,494,711 to H. Kusher et al. discloses a garment hanger having sleeves that slide over the shoulder portions of the curved frame. A horizontally oriented locating pin inside the sleeve engages a long row of detents formed by ridges and grooves on the frame. The friction generated between the pin and detents holds the sleeves at the desired width.

Unfortunately, all of the foregoing devices are rather complicated in structure, or lack strength, or both. Indeed, many prior art hangers are too flimsy to support heavy-weight fabric garments such as a winter overcoat. Moreover, the mechanisms used to achieve adjustability are not sufficiently strong to support the weight of a heavy coat, and the adjustments tend to slip out of their intended positions. Some of the conventional hangers that do have stronger frames unfortunately use very complicated mechanical parts to interlock the adjustable or movable members. This significantly increases the cost of fabrication of the hanger.

To be sure, cost of a hanger is often a major consideration. Although modem technology has produced hangers made of plastic instead of wire or wood to minimize costs, the finished product is still flimsy and typically has no adjustable features.

For example, most conventional plastic hangers have a simple triangular frame depending from a hook. The hanger usually has a simple circular cross-sectional shape to keep tooling and fabrication costs low. This type of design although inexpensive and simple to manufacture does not have sufficient strength or adjustability for modem day applications. Therefore, a need presently exists for an adjustable garment hanger that is sturdy and has positive locking adjustments, yet is very inexpensive to fabricate.

SUMMARY OF THE INVENTION

In view of the foregoing, it is an object of the present invention to provide a garment hanger that has a strong and rigid frame. It is another object of the present invention to provide a garment hanger that has shoulder pieces that can be adjusted to increase or decrease the width of the hanger. It is still another object of the present invention to provide shoulder pieces that tilt to change the angle of the shoulder piece relative to the frame. It is still another object of the present invention to provide a garment hanger that has a positive locking mechanism to solidly lock and position the shoulder pieces relative to the frame. It is still yet another object of the present invention to provide a garment hanger that features a positive locking mechanism that can be operated easily and reliably. It is another object of the present invention to provide a garment hanger that can be fabricated in very few pieces with few manufacturing steps from a material that is very inexpensive.

To achieve the foregoing objects, the present invention in a preferred embodiment provides an adjustable garment hanger comprising a hook having a base, a pair of outward extending and inclined arms depending from the base of the hook, and an optional cross bar joining the inclined arms to substantially form a triangular frame. The adjustable garment hanger further comprises a shoulder region cover for each inclined arm, wherein according to one embodiment each cover is selectively supported on the inclined arm or a ramp formed into the sides of the inclined arm to tilt the cover relative to the inclined arms.

The frame further comprises a notched locking bar extending along each inclined arm, wherein each notched locking bar includes a proximate end integral with the inclined arm and a free distal end biased away from the inclined arm. The bias of the locking bar forces a notch into engagement with a rib formed in the cover. In addition, the free distal end of each locking bar optionally includes a pushbutton that when depressed under thumb or finger pressure disengages the locking bar from the rib of the cover against the bias force of the locking bar.

With the pushbuttons depressed, the covers freely slide along the respective inclined arms of the adjustable garment hanger. When the pushbuttons are released, the bias in each locking bar again forces a notch into engagement with the rib of the cover. Through the foregoing process, the width of the hanger can be easily adjusted and a positive lock achieved.

Each shoulder region cover can be tilted by aligning a rib formed in the outer end of the cover with a ramp on the inclined arm thereby tilting the cover relative to the inclined arms. This adjusts the garment hanger to fit the shoulder slope of any article of clothing. The outer portion of the cover both slides and moves up and down upon the inclined arm while the portion of the cover nearest the base can only slide on the inclined arm. The inner portion therefore serves as a pivot location for the tilting operation.

Optional tabs formed at the base of the hook and biased outward help to hold the tilt position of the covers while also keeping the locking bars within their operating positions. In a preferred embodiment of the present invention, the adjustable garment hanger has improved rigidity and strength by incorporation of I-shape cross-sections throughout the frame and hook. An optional reinforcement bar is positioned above the cross bar and extends from one inclined arm to the other.

The present invention is designed for ease of manufacturability wherein the entire structure can be injection molded when an inexpensive plastic is used as the base material. Indeed, the frame, locking bars, hook, tabs, and like hardware can be injection molded as a single piece. The pair of covers are also preferably injection molded separately and then added onto the frame. The simplicity of the structure with only three major parts insures that manufacturing costs are very low and reliability of operation is very high. On the other hand, the present invention has a sturdy frame with positive locks that consistently and rigidly maintain the tilt and adjusted positions of the covers.

BRIEF DESCRIPTION OF THE DRAWINGS

The objects, features and advantages of the present invention will be apparent to one skilled in the art from reading the following detailed description in which:

FIGS. 2–4 illustrate some of the various placements for the covers, wherein FIG. 2 shows the covers in the retracted position, FIG. 3 shows the covers in the extended position, and FIG. 4 shows the covers in the extended and tilted position.

DETAILED DESCRIPTION OF THE INVENTION

The following specification describes an adjustable garment hanger. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

The present invention is directed to an adjustable garment hanger. In a preferred embodiment, the adjustable garment hanger has a triangular shape frame depending from a suspending means such as a hook. The triangular frame is preferably comprised of outward extending and inclined arms intersected by a cross bar. A pair of shoulder region covers are slidably disposed on the inclined arms. One or more ramps may be formed into each inclined arm so that in certain positions, the cover is supported by the ramp, thereby tilting the cover relative to the inclined arm.

In addition, the adjustable garment hanger includes a pair of locking bars formed into the inclined arms, wherein each locking bar has notches or stops that engage at least one rib formed in the cover. Alternatively, the locking bar may have protruding ribs, and the cover may have corresponding indentations. Each locking bar has a distal end that is preferably biased away from the inclined arm and into engagement with the rib of the cover. This design provides a positive and reliable locking mechanism for holding the extended or retracted positions of the covers along the inclined arms.

In a preferred embodiment, the distal end of the locking bar includes a pushbutton that when depressed under finger pressure disengages the locking bar from the rib of the cover thereby allowing the cover to freely slide along the inclined arms. As mentioned above, the locking bar preferably has a plurality of ridges, detents, stops, or notches so that it is possible to lock the cover at different positions along the length of the inclined arm. Such notch features may have angled limits so that a sufficiently high force upon the cover will cause the engaging rib to disengage. In an alternative embodiment, there may be no push buttons and applied sliding force to the cover is the primary means of disengagement. This feature of the present invention enables one to adjust the width of the hanger to a variety of sizes.

Figure 2:
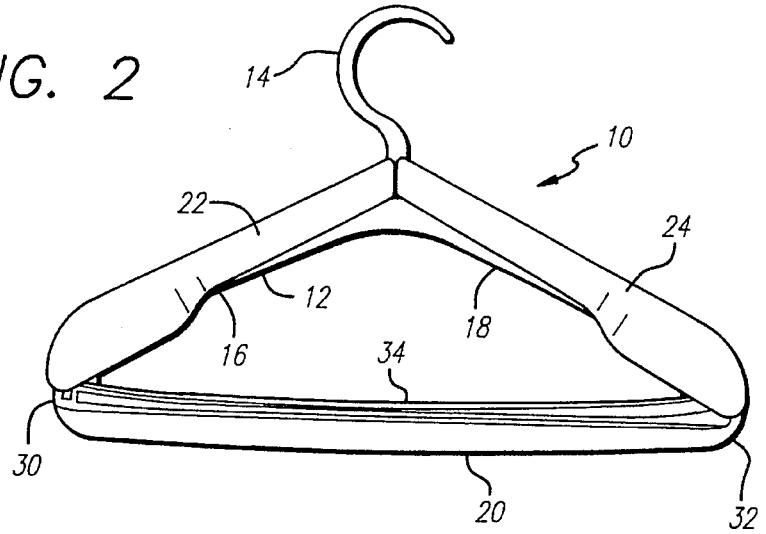
Figure 3:
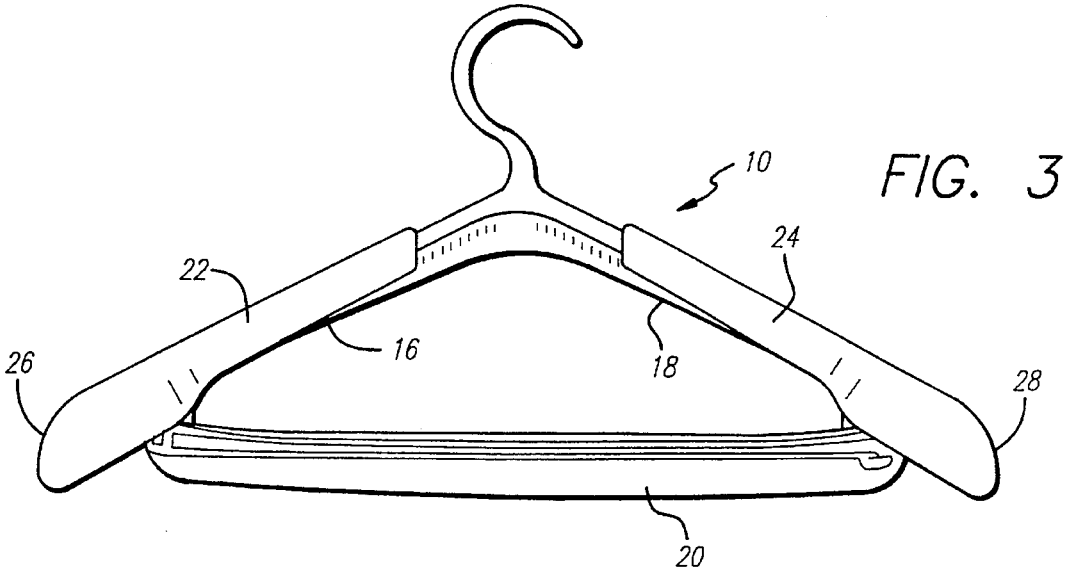
Figure 4:
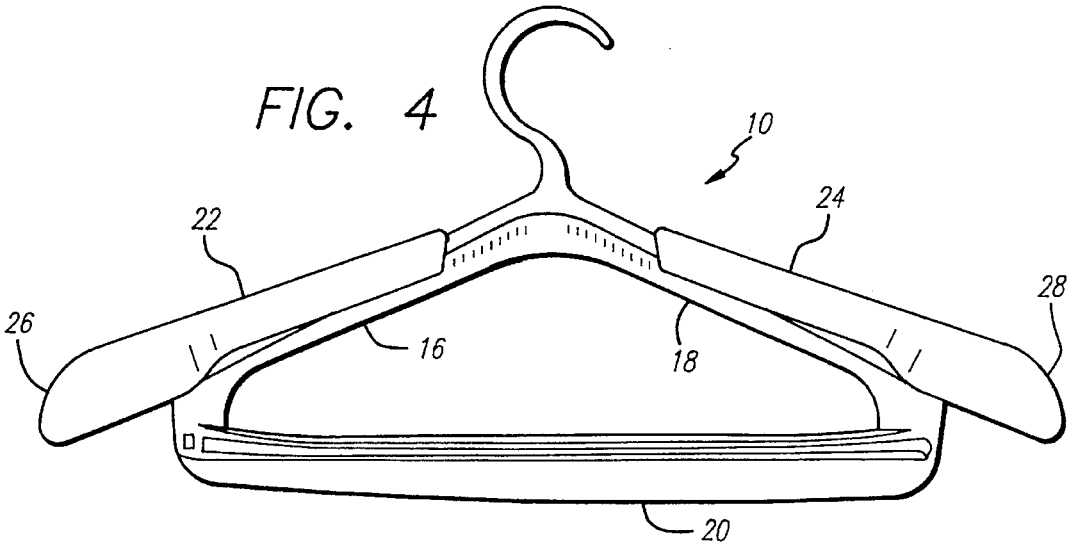

Some of the possible cover placements and orientations of the present invention are shown in FIGS. 2–4. FIG. 2 shows a preferred embodiment of the present invention hanger 10. The hanger 10 has preferably a triangular shape frame 12 dependent from a suspension means such as a hook 14. Although a hook 14 is shown, clearly any suspension means known in the art such as clamps, dips, loops, suction cups, or the like can be used. The triangular frame 12 is comprised of two inclined arms 16, 18, intersected by an optional cross bar 20 forming the three legs of the triangle. Disposed over the inclined arms 16, 18 are shoulder region covers 22, 24.

FIG. 3 depicts the covers 22, 24 in a fully extended position, which significantly increases the width of the hanger 10. The outer ends 26, 28 can be repositioned upward to tilt the covers 22, 24 relative to the angle of the inclined arms 16, 18. This is shown in FIG. 4. According to the preferred embodiment, covers 22, 24 must be moved to an innermost position to adjust the angle. According to one embodiment of the invention, the cover does not slide along the arm, but may be repositioned to different angles. In every case of a tiltable version of the invention, the cover inner ends serve as a pivot location.

Although FIG. 3 shows the covers 22, 24 in the fully extended position, it is possible to move the covers 22, 24 to numerous intermediate positions in order to obtain different widths. To simplify the illustration, the locking bar and other minor hardware have been omitted from FIGS. 2–4.

Figure 1:
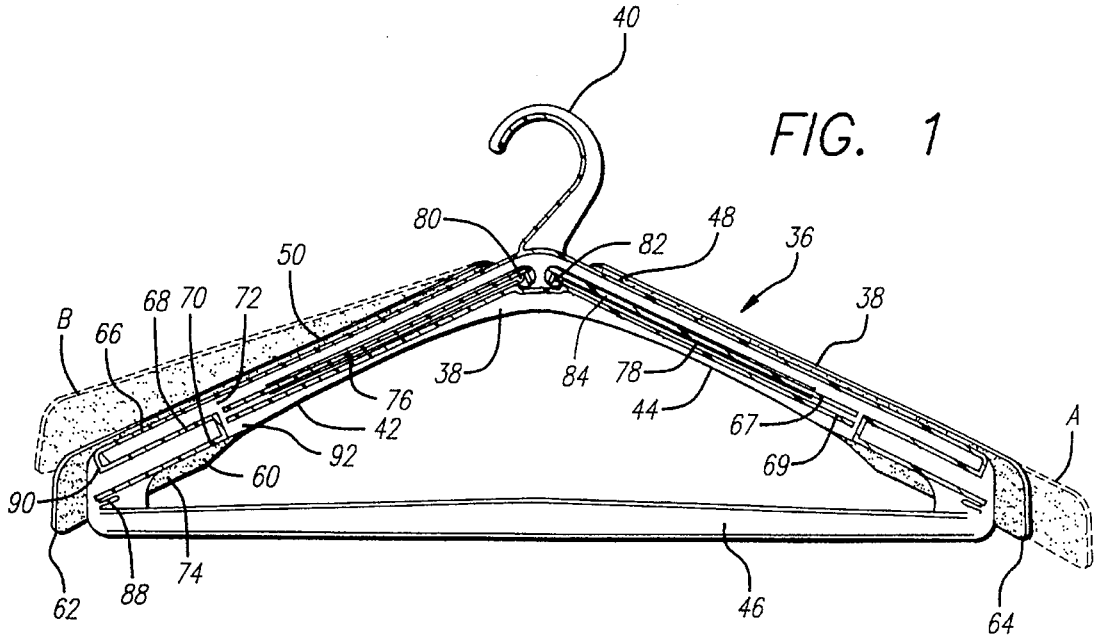
FIG. 1 shows a preferred embodiment of the present invention garment hanger wherein the adjustable shoulder region covers are cut away to expose the frame; alterative positions of the covers are shown in dashed lines.

FIG. 1 shows another exemplary embodiment of the present invention adjustable garment hanger 36. The hanger 36 again preferably has a triangular shape frame 38 depending from a suspending means such as a hook 40. The triangular shape frame 38 is comprised of inclined arms 42, 44 intersected by a cross bar 46. Each inclined arm 42, 44 is partially enclosed by a shoulder region cover 48, 50.

Similar to the embodiment of FIGS. 2–4, the exemplary embodiment of FIG. 1 provides covers 48, 50 that extend partially or completely outward into position A, can be tilted at different angles into position B, or both. This is denoted by the dashed outline of the covers 48, 50.

Figure 7:
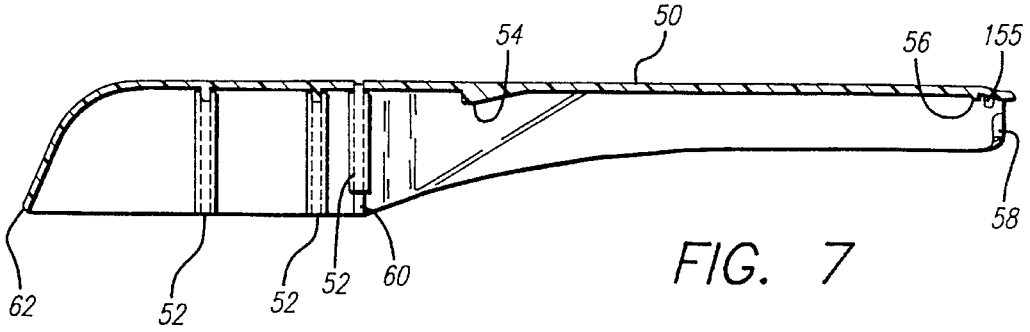
FIG. 7 is a sectional side elevational view taken along the length of a shoulder region cover to expose the interior structure.
Figure 8:
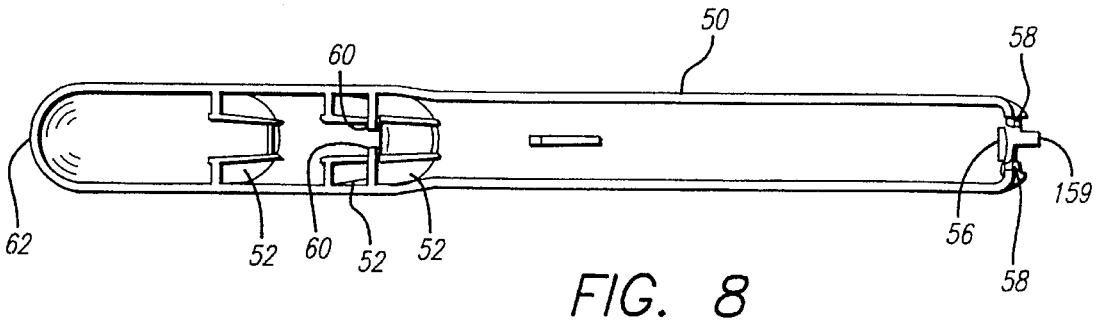
FIG. 8 is a bottom perspective plan view of the cover shown in FIG. 7.

A preferred embodiment cover 50 is shown in FIG. 7. Specifically, FIG. 7 is a sectional, side elevational view of the cover 50 taken along the length of the cover to expose the interior structure. FIG. 8 is a bottom plan view of the cover 50 shown in FIG. 7. In the exemplary embodiment, the cover for the left side is identical to the cover for the fight side of the hanger, although this is not mandatory.

Cover 50 as seen in FIGS. 7 and 8 has a generally tubular shape and is fully open at the bottom with a hollow interior that is supported by bulkheads 52. The exterior surface of the cover 50 can optionally be contoured as needed to tailor fit the cover 50 to a particular article of clothing. The bulkheads 52 are in sliding contact with the side faces of the frame arm, providing support and torsional and bending rigidity to the cover 50. The cover 50 also includes optional support surfaces 54, 56.

Moreover, cover 50 preferably includes locating ribs 58 and retaining tabs 60. In a preferred embodiment, at least one of the locating tabs 58 help hold the cover 50 at a position along the length of the inclined arm 42. The retaining tabs 60, on the other hand, help maintain the cover 50 on the inclined arm 42, and more importantly, are used to tilt the outer ends 62, 64 of the covers 48, 50.

As seen in FIG. 1, the present invention hanger 36 includes guide ribs 66, 68, 70 that together form channels 72, 74 used to guide the movement of the cover 50. Channel 74 is a partially open space below rib 70. Importantly, these structures are preferably formed on both sides of each inclined arm 42, 44. The retaining tabs 60 freely slide within channels 72 and 74. In order to allow movement of retaining ribs 60 between channels 72 and 74, a slot 92 is provided therebetween. To adjust the tilt, cover 50 is slid to its innermost position so that tab 60 is aligned with slot 90. Cover 50 may then be adjusted up or down to align tab 60 with either channel 72 or 74. When the cover 50 is maneuvered so that retaining ribs 60 are placed into channel 72, guide rib 68 functions essentially as a ramp supporting the outer end 62 of cover 50, and in turn holding cover 50 tilted relative to inclined arm 42. Ribs 58 slide along guide ribs 67 and 69 to provide support for the inner end of cover 50. Ribs 67 and 69 also form a pivot point for the inner of cover 50 during the tilting operation. Channel 72 and slot 92 may be omitted to provide a simplified non-tilting version of the invention.

In the exemplary embodiment shown in FIG. 1, there is a locking bar 76, 78 located in the respective inclined arms 42, 44. The base of each locking bar 76, 78 is formed integrally with the respective inclined arm 42, 44 while the distal end includes a pushbutton 80, 82. The locking bar 76, 78 extends within an elongated slot formed into the triangular shape frame 38. The distal end of each locking bar 76, 78 where the pushbutton 80, 82 is located is biased out of the plane of the triangular shape frame 38. The bias is simply a result of the natural springback in the base material. Along the side of each locking bar 76, 78 are multiple notches 84 that, from the bias of the locking bar, engages one of the ribs 58. In an alternative embodiment, notches 84 may instead be replaced by protruding ribs that fit corresponding notches in cover 50.

That is, the two locking bars 76, 78 on the respective inclined arms 42, 44 operate opposite to each other with respect to the plane defined by frame 38. The locking bars are pressed, against the bias, into the plane defined by frame 38 when covers 48, 50 are installed. With finger or thumb pressure against pushbuttons 80, 82, the locking bars 76, 78 are forced into the plane of the frame 38 against the respective bias of each locking bar, thereby disengaging one of the ribs 58 of covers 48, 50 from engagement with the respective notch 84. This then frees the covers 48, 50 to slide along the inclined arms 42, 44 until an alternative extended or retracted position is found. Releasing the pushbuttons 80, 82 allows the locking bars 76, 78 to move outward again under bias to engage a notch 84 to a rib 58.

In an alternative embodiment (not shown), the locking bar base would be positioned near the base of the hook and the locking bar would extend downward along the inclined arm.

As should be clear by now, the ribs, channels, cover, and other structures of inclined arm 44 are preferably identical to that on inclined arm 42. In fact, one arm is merely the other arm rotated 180 degrees.

Cover 50 is installed on frame 38 by guiding the cover 50 over inclined arm 42 until retaining rib 60 slides over the crest of a wedge-shape ramp 88 at which point the cover 50 is retained on the inclined arm 42. In the tilted condition of cover 50, rib 90 prevents the retaining ribs 60 from running out of the outside end of channel 72. The identical structures are featured on the right hand inclined arm 44 and cover 48 as well.

Figure 5:
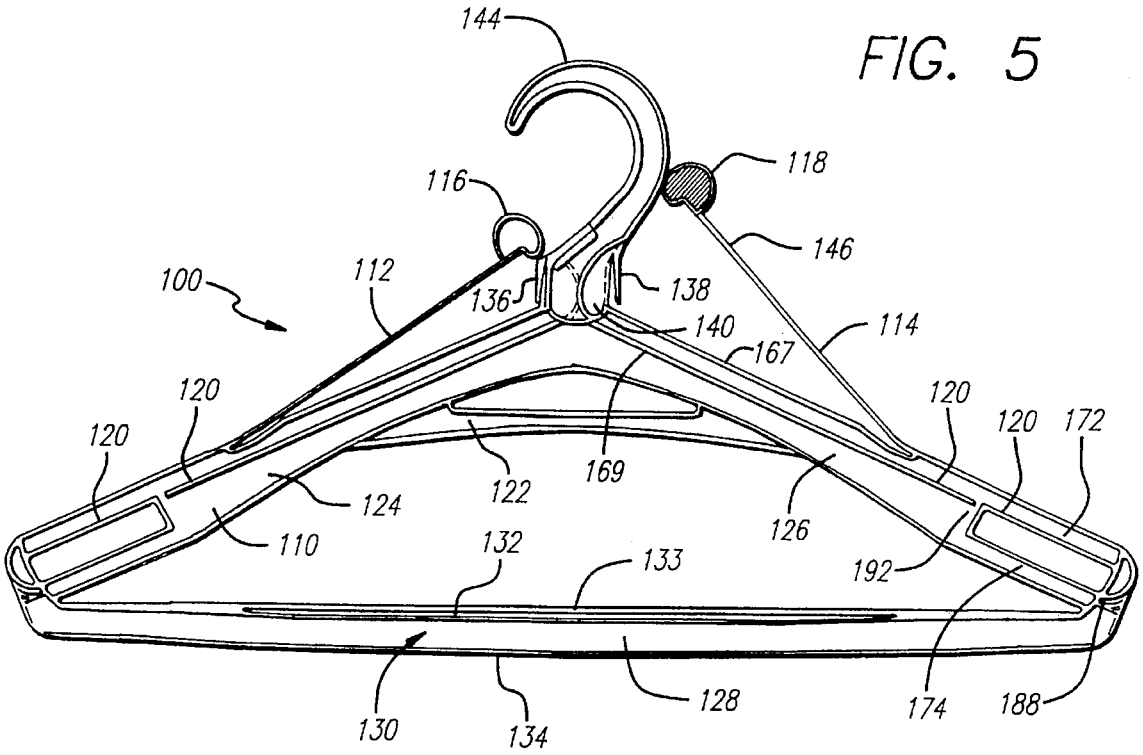
FIG. 5 shows a preferred embodiment frame of the present invention without the shoulder region covers, wherein the locking bars are in the free position immediately after ejection from a molding machine.

FIG. 5 shows yet another exemplary embodiment of the present invention. The hanger 100 is illustrated without covers to expose the details of the triangular shape frame 110. The frame 110 in FIG. 5 is very similar to the frame shown in FIG. 1, except in the FIG. 5 embodiment, the locking bars 112, 114 are biased upward and outward away from the vertical plane defined by the frame 110. The locking bars 112, 114 are each formed integrally with frame 110 and have a free distal end. The distal ends of the locking bars 112, 114 preferably include textured pushbuttons 116, 118.

Hook 144 has a tapered profile to minimize material usage and to provide a distinct appearance. Similar to the exemplary embodiment of FIG. 1, the present embodiment hanger has a frame 110 that includes ribs 120 that form channels to retain the cover onto the frame 110 as the cover undergoes its sliding and tilting motions. The hanger 100 of FIG. 5 also includes a reinforcement cross bar 122 extending from one inclined arm 124 to the other inclined arm 126. This optional reenforcement cross bar 122 improves the torsional and bending rigidity of the triangular shape frame 110. Bar 122 may also support various small apparel items.

Another feature of the present invention that adds strength to the hanger 100 is the use of T-shape cross sections throughout, as seen in FIGS. 1 and 5. In some instances, the cross sectional shape may also resemble an I-beam. For example, in the lower cross bar 128, the cross-section is formed by a narrow, vertical center section 130 terminating at opposite ends by flat, wide end sections 132, 134, thus forming an imaginary I. Additional rib 133 above section 132 provides the option of an effectively rounded shape to the top of cross bar 128. All ribs preferably have smoothly rounded edges.

The present invention in a preferred embodiment provides downward-pointing tabs 136, 138 that are biased outward. The tabs 136, 138 are used to hold the respective locking bars 112, 114 in their operating position after the locking bars 112, 114 are pushed thereunder. Furthermore, when the pair of covers 50, each similar to the one shown in FIG. 8, are assembled to the inclined arms 124, 126 and slid fully toward the base of hook 144, tab 159 of FIG. 8 presses the distal end of cantilevered spring tabs 136, 138. Tabs 136, 138 then spring bias the covers outward. Spring tabs 136, 138 control the transition of retaining tab 60 between channels 172 and 174 by forcing tab 60 into one of channels 172, 174. The covers must be pressed against tabs 136, 138 to cause tab 60 to enter slot 192 and allow adjustment of the angle of the covers. Importantly, channel 172 and slot 192 may be omitted to provide a simplified alternative embodiment of the present invention with non-tilting shoulder portions.

Ramp 188 serves as a one way assembly feature to retain the cover on the frame. The slides of cover 50 deflect outward of the tabs 60 to pass ramp 188. Ramp 188 drops off abruptly to prevent tabs 60 from sliding back past ramp 188.

Figure 6:
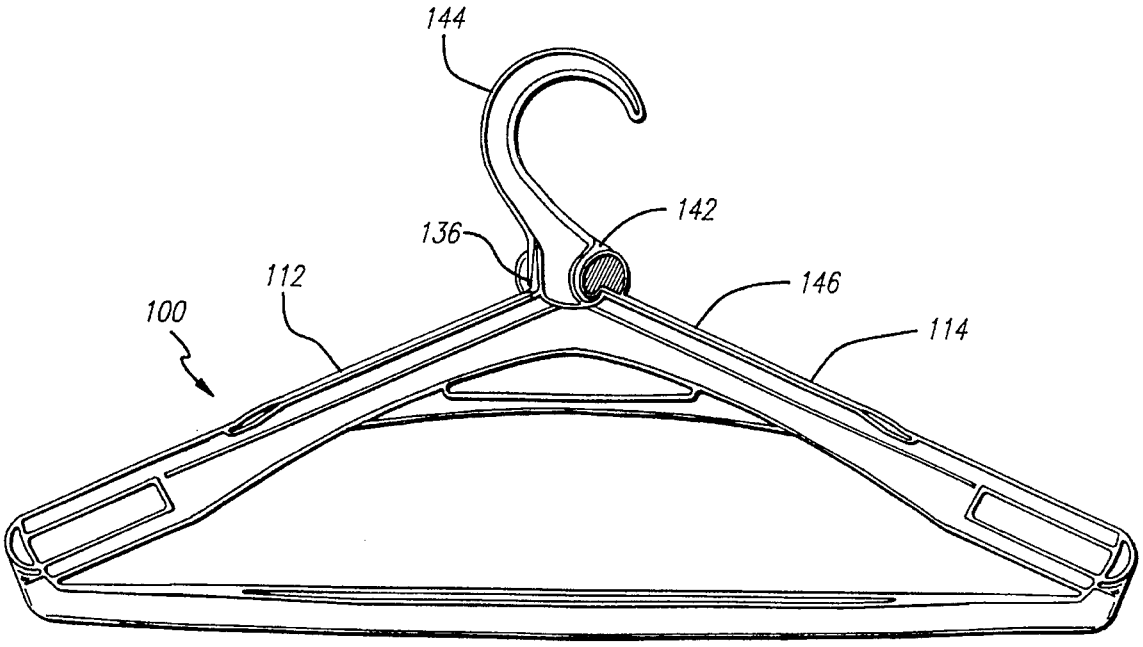
FIG. 6 shows the opposite side of the garment hanger frame from FIG. 5, wherein the locking bars have been moved into position just prior to attachment of the shoulder region covers to the frame.

FIG. 6 shows the back side of hanger 100 wherein the locking bars 112, 114 have been snapped into operating position and held in place against their bias by tabs 136, 138. Recess 140, 142 are provided at the base of the hook 144. The recesses 140, 142 are designed to receive the pushbuttons 116, 118. Ridges, detents, stops, or notches 146 are formed into one side of each locking bar 112, 114. As in the previous embodiment, the locking bar 112, 114 is biased outward away from the plane of the frame 110 thereby forcing the notch 146 into engagement with rib 155 of cover 50 in order to lock the position of the cover relative to the frame in a detent action. As in the previous embodiments, the locations of the notches 146 determine the degree of extension of the covers, thereby affecting the width of the entire hanger 100. In the case of hanger 100, rib 58 of cover 50 serves only as a guide between ribs 167 and 167.

The present invention adjustable garment hanger is preferably made from a polymer that can be injection molded. Indeed, the present invention hanger is designed so that there are only three major parts: namely, the triangular frame with the hook, and the two covers. In a preferred embodiment shown in FIG. 5, the frame and hook with the raised locking bars are as they appear when the structure is ejected from an injection molding machine with the locking bars raised to facilitate molding the frame 110 as one piece. Alternatively, the locking bars could be attached to frame 110 as separate components. As mentioned above, FIG. 6 shows the locking bars 112, 114 after they have been snapped into operating position under tabs 136, 138, just prior to assembly of the covers to the frame. The preferred embodiment covers shown in FIGS. 7 and 8 are also easily injection molded in one piece.

Therefore, the present invention is easily fabricated from any inexpensive material such as polypropylene. Other materials known in the art having some resilient qualities can be used, too.

The present invention hanger thus has very few parts and is inexpensive and simple to manufacture. Despite its simple construction, the hanger nevertheless provides an adjustment to increase or decrease its width as well as an adjustment to tilt the shoulder area. Moreover, the adjustments employ positive locking mechanisms so that there is no slippage as garments are installed on to and removed from the hanger.

What is claimed is:

1. An adjustable garment hanger comprising:

a hook having a base;

a pair of outward extending and inclined arms depending from the base of the hook;

a ramp disposed on each inclined arm;

a pair of covers, each cover being selectively supported on the inclined arm and the ramp to tilt the cover relative to the inclined arms, and wherein each cover includes a rib;

a notched bar extending along each inclined arm, wherein each notched bar includes a proximate end integral with the inclined arm and a free distal end biased away from the inclined arm; and wherein the bias of the notched bar forces a notch into engagement with the rib of the cover.

2. The adjustable garment hanger of claim 1, wherein each notched bar further comprises a finger push surface disposed at the distal end for leverage against the bias and to disengage the notched bar from the rib.

3. The adjustable garment hanger of claim 1, wherein the garment hanger further comprises one or more reinforcement bars joining the inclined arms.

4. The adjustable garment hanger of claim 1, wherein the ramp further comprises a channel having an inside and an outside, and wherein the cover further comprises a retaining tab selectively disposed inside and outside the channel.

5. The adjustable garment hanger of claim 1, wherein each notched bar further comprises a pushbutton disposed at the distal end for leverage against the bias and to disengage the notched bar from the rib.

6. The adjustable garment hanger of claim 1, wherein the garment hanger further comprises an injection molded polymer material.

7. The adjustable garment hanger of claim 1, wherein the inclined arms and cross bar have an I-shape cross-section.

8. The adjustable garment hanger of claim 1, wherein the hook near the base further comprises a tab biased outward so that the notched bar is retained thereunder.

9. The adjustable garment hanger of claim 1, wherein the hook, inclined arms, cross bar, and notched bars are formed in one continuous piece.

10. An adjustable garment hanger comprising:

a means for suspending;

a pair of outward extending and sloping arms depending from the means for suspending;

a pair of locking bars each integral with the sloping arms and biased away from the sloping arms at a distal end, and wherein the locking bars include stops;

a ramp disposed on each sloping arm;

a pair of covers, each cover selectively disposed on the sloping arm and supported by the ramp to tilt the cover, wherein each cover includes a rib; and wherein the bias of the locking bar forces positive engagement of at least one of the stops against the rib.

11. The adjustable garment hanger of claim 10, wherein the cover further comprises a half cylinder shell and at least one retaining bulkhead disposed therein.

12. The adjustable garment hanger of claim 10, wherein the sloping arms include a plurality of channels, and wherein each cover includes a retaining tab guided by the channels.

13. The adjustable garment hanger of claim 11, wherein the cover is further comprised of a singular, continuous structure.

14. The adjustable garment hanger of claim 10, wherein the adjustable garment hanger further comprises a plurality of ramps arranged in a stacked formation.

15. The adjustable garment hanger of claim 10, wherein the garment hanger further comprises one-piece injection molded sloping arms and cross bar.

16. The adjustable garment hanger of claim 10, wherein each sloping arm further comprises a plurality of ramps for tilting the cover at a plurality of angles.

17. The adjustable garment hanger of claim 10, wherein the stops are disposed on a lateral face of the locking bar.

18. The adjustable garment hanger of claim 10, wherein the arms are joined to form a one piece polygon.

19. An adjustable garment hanger comprising:

a hook;

a one-piece frame dependent from the hook including downward sloping arms;

elongated locking bars attached to the frame and extending along each downward sloping arm, each locking bar including a plurality of detent elements along its length; and a cover, slidably disposed on each sloping arm and over each locking bar, and selectively engaging the locking bar at said plurality of detent elements, wherein the locking bar is biased toward the cover.

20. The adjustable garment hanger of claim 19, wherein each cover includes a plurality of guiding ribs, and each sloping arm includes tracks within which the retaining ribs slide.

21. The adjustable garment hanger of claim 19, wherein the cover slides over a wedge shaped ramp when the cover is first fitted upon the frame, and wherein the wedge shaped ramp forms a stop to securely retain the cover upon the sloping arm.

22. The adjustable garment hanger of claim 19, wherein a distal end of each locking bar further comprises a textured pushbutton, wherein each pushbutton is disposed on opposite sides of the hook.

23. An adjustable garment hanger comprising:

a hook;

a one piece plastic frame dependant from the hook including downward sloping arms;

an elongated cover fitted upon each downward sloping arm including a cover inward end facing toward the hook, and a cover outward end located away from the hook;

the cover inward end pivotally attached to the sloping arm;

the sloping arm including multiple ribs engageable with the cover outer end;

the cover outer end moveable upward and downward to enable at least two tilt angles between the cover and the sloping arm;

the cover engaging different ribs of the sloping arm for respective different tilt angles.

24. The adjustable garment hanger of claim 23, wherein:

the cover inward end is pivotally and slidably attached to the sloping arm;

the cover outward end is movable upward, downward and slidably upon the sloping arm;

the cover may be slidably repositioned toward and away from the hook.

25. The adjustable garment hanger of claim 24, wherein the cover may be tilted to a different angle only when the cover is slid to a predetermined location along the sloping arm.

* * * * *